US008739323B2

(12) United States Patent
Lee

(10) Patent No.: US 8,739,323 B2
(45) Date of Patent: Jun. 3, 2014

(54) AIR INJECTION BATHTUB

(76) Inventor: Sang-Bae Lee, Ulsan (KR)

( * ) Notice: Subject to any disclaimer, the term of this patent is extended or adjusted under 35 U.S.C. 154(b) by 0 days.

(21) Appl. No.: 13/531,691

(22) Filed: Jun. 25, 2012

(65) Prior Publication Data

US 2012/0304375 A1 Dec. 6, 2012

Related U.S. Application Data

(63) Continuation of application No. PCT/KR2011/005901, filed on Aug. 11, 2011.

(30) Foreign Application Priority Data

Jun. 1, 2011 (KR) ..... 10-2011-0052550

(51) Int. Cl.
*A61H 33/06* (2006.01)
*A61H 33/02* (2006.01)

(52) U.S. Cl.
CPC ..... *A61H 33/02* (2013.01); *A61H 33/025* (2013.01)
USPC ..... 4/541.5; 4/541.4

(58) Field of Classification Search
CPC ..... A61H 33/02; A61H 33/025
USPC ..... 4/541.3–541.5
See application file for complete search history.

(56) References Cited

U.S. PATENT DOCUMENTS

| | | | | | |
|---|---|---|---|---|---|
| 2,856,611 | A | * | 10/1958 | Velonis | 4/541.5 |
| 3,251,071 | A | * | 5/1966 | Wood | 4/541.5 |
| 4,048,266 | A | * | 9/1977 | Baumann | 4/541.5 |
| 4,546,505 | A | * | 10/1985 | Wakenshaw | 4/541.3 |
| 5,307,529 | A | * | 5/1994 | Wang | 4/541.5 |

* cited by examiner

*Primary Examiner* — Tuan N Nguyen
(74) *Attorney, Agent, or Firm* — Park & Associates IP Law, P.C.

(57) ABSTRACT

An air injection bathtub includes: a body part having a coupling recess formed depressedly on the bottom surface thereof; a plate part adapted to be fit to the coupling recess of the body part and having a connection groove formed depressedly on one side of the underside surface thereof, at least one air passing grooves formed depressedly on the underside surface thereof in a manner as to communicate with the connection groove and to pass the air supplied from the connection groove therethrough, and at least one air injection through-holes formed on the top surface of the plate part to inject the air passing through the air passing grooves into the body part; and a valve part disposed below the connection groove in a manner as to be open and closed through the air pressure supplied from the outside and to supply air to the connection groove.

8 Claims, 10 Drawing Sheets

AIR INJECTION BATHTUB

REFERENCE TO RELATED APPLICATIONS

This is a continuation of pending International Patent Application PCT/KR2011/005901 filed on Aug. 11, 2011, which designates the United States and claims priority of Korean Patent Application No. 10-2011-0052550 filed on Jun. 1, 2011, the entire contents of which are incorporated herein by reference.

FIELD OF THE INVENTION

The present invention relates to an air injection bathtub, and more particularly, to an air injection bathtub that is newly improved in structure to prevent foreign matters like water scale from remaining inside an air injection device.

BACKGROUND OF THE INVENTION

Generally, a massage bathtub is provided by injecting air or water from the water stored thereinto to collide the injected air or water against a bather's body, thereby massaging his or her body and releasing his or her muscle pain or fatigue.

The massage bathtub is largely classified into wet type bathtubs adapted to circulate and inject the water stored thereinto through a plurality of injection nozzles formed on the side surfaces of the bathtub by the activation of a pump, and dry type bathtubs adapted to inject the compressed air generated from an air blower through a plurality of injection nozzles formed on the bottom portion of the bathtub.

However, the wet type bathtubs need an independent pipe for circulating the water stored thereinto, thereby making it hard to install and repair the bathtub, and further, a relatively high installation cost is required. Thus, since the dry type bathtubs inject fine air bubbles into the water stored therein, without having any pipe for circulating the water, they have been recently popularized.

On the other hand, an example of the dry type bathtubs is disclosed in Korean Utility Model Registration No. 0349584 (entitled 'air injection bathtub').

According to the above-mentioned prior art, the air injection bathtub that is open on the upper portion thereof, the bathtub including: a body part having a plurality of air injection holes punched on the bottom surface thereof; a cover part disposed sealingly on the underside surface of the body part so as to cover the plurality of air injection holes; an air blower disposed inside a case placed at one side of the outside of the body part to convey air to the interior of the cover part; a heater disposed at the outlet of the air blower inside the case to heat the air; a hose connected between the outlet side of the case and one side of the cover part to convey the air passing through the heater; a check valve disposed at the center of the hose to shut off the reverse flow of the water in the hose; a remote controller adapted to control the air blower and the heater; and a valve disposed on the other side of the cover part to discharge the water remaining in the cover part.

According to the prior art, however, if the air injection into the air injection holes stops, the water stored in the bathtub is introduced into the space between the air injection holes and the cover part, and in this state, even though the air is injected through the activation of the air blower, the water is rarely discharged to the outside and still remains thereinto. Accordingly, the water is changed into foreign matters like water scale, and the foreign matters are discharged again to the interior of the bathtub through the air injection holes, thereby making the water in the bathtub dirty or causing bad odors from the water.

SUMMARY OF THE INVENTION

Accordingly, the present invention has been made in view of the above-mentioned problems occurring in the prior art, and it is an object of the present invention to provide an air injection bathtub that is capable of preventing foreign matters like water scale from remaining inside an air injection device, thereby being maintained in a clean state.

It is another object of the present invention to provide an air injection bathtub that is capable of allowing the water existing in air passing grooves to be naturally induced to a drain through drain induction grooves.

To accomplish the above objects, according to a first aspect of the present invention, there is provided an air injection bathtub including: a body part having a coupling recess formed depressedly on the bottom surface thereof; a plate part adapted to be fit to the coupling recess of the body part and having a connection groove formed depressedly on one side of the underside surface thereof, at least one or more air passing grooves formed depressedly on the underside surface thereof in such a manner as to communicate with the connection groove and to pass the air supplied from the connection groove therethrough, and at least one or more air injection through-holes formed on the top surface of the plate part to inject the air passing through the air passing grooves into the body part; and a valve part disposed below the connection groove in such a manner as to be open and closed through the air pressure supplied from the outside and to supply air to the connection groove.

To accomplish the above objects, according to a second aspect of the present invention, there is provided an air injection bathtub including: a body part having a connection groove formed depressedly on one side of the bottom surface thereof and at least one or more air passing grooves formed depressedly on the bottom surface thereof in such a manner as to communicate with the connection groove and to pass the air supplied from the connection groove therethrough; a plate part disposed on the bottom surface of the body part and having at least one or more air injection through-holes formed on the top surface thereof to inject the air passing through the air passing grooves into the body part; and a valve part disposed below the connection groove in such a manner as to be open and closed through the air pressure supplied from the outside and to supply air to the connection groove.

To accomplish the above objects, according to a third aspect of the present invention, there is provided an air injection bathtub including: a body part having at least one or more air injection through-holes formed on the bottom surface thereof to inject the air passing through at least one or more air passing grooves formed on a plate part into the body part; the plate part disposed on the underside surface of the body part and having a connection groove formed depressedly on one side of the top surface thereof and the at least one or more air passing grooves formed on the top surface thereof in such a manner as to communicate with the connection groove and to pass the air supplied from the connection groove therethrough; and a valve part disposed below the connection groove in such a manner as to be open and closed through the air pressure supplied from the outside and to supply air to the connection groove.

To accomplish the above objects, according to a fourth aspect of the present invention, there is provided an air injection bathtub including: a body part having a connection groove formed depressedly on one side of the bottom surface thereof, at least one or more air passing grooves formed on the underside surface thereof in such a manner as to communicate with the connection groove and to pass the air supplied from the connection groove therethrough, and at least one or more air injection through-holes formed on the bottom surface thereof to inject the air passing through the air passing grooves into the body part; a plate part covered on the underside surface of the body part; and a valve part disposed below the connection groove in such a manner as to be open and closed through the air pressure supplied from the outside and to supply air to the connection groove.

According to the present invention, desirably, the body part has a drain formed on underside surface thereof and at least one or more drain induction grooves formed depressedly along one side outer periphery of the drain, the drain induction grooves having one ends connected to the air passing grooves and the other ends connected to the drain to induce the water existing in the air passing grooves to the drain.

According to the present invention, desirably, the valve part includes: a body having a shape of a hollow cylinder open on the upper portion thereof in such a manner as to be disposed below the connection groove, the body having an air passing through-hole formed along the periphery of the bottom surface thereof, through which the air supplied from the outside is passed; a cover plate adapted to be covered on the open top surface of the body in such a manner as to be moved upwardly by the air pressure introduced into the body through the air passing through-hole and thus to open the top surface of the body; and a guide shaft coupled at one end thereof to the center of the underside surface of the cover plate and coupled fittedly at the other end thereof to a through-hole formed at the center of the bottom surface of the body in such a manner as to guide the upward and downward operations of the cover plate through the air pressure.

According to the present invention, the elongated air passing grooves are formed on the underside surface of the plate part constituting the air injection device, and the air injection through-holes formed on the plate part communicate with the air passing grooves, such that even though water is introduced into the air passing grooves, the water introduced with air discharging pressure does not remain in the air passing grooves and is discharged again through the air injection through-holes, thereby previously preventing foreign matters like water scale to be generated in the air passing grooves to always keep the bathtub in a clean state.

DETAILED DESCRIPTION OF THE INVENTION

Hereinafter, an explanation on an air injection bathtub according to preferred embodiments of the present invention will be given with reference to the attached drawings.

According to the present invention, elongated air passing grooves are formed on the underside surface of a plate part constituting an air injection device, and air injection through-holes formed on the plate part communicate with the air passing grooves, such that even though water is introduced into the air passing grooves, the water introduced with air discharging pressure does not remain in the air passing grooves and is discharged again through the air injection through-holes, thereby previously preventing foreign matters like water scale to be generated in the air passing grooves to always keep the bathtub in a clean state.

Now, the air injection bathtub according to first to fourth embodiments of the present invention will be described. While the present invention has been described with reference to the particular illustrative embodiments, it is not to be restricted by the embodiments. It is to be appreciated that those skilled in the art can change or modify the embodiments without departing from the scope and spirit of the present invention.

First Embodiment

Figure 1:
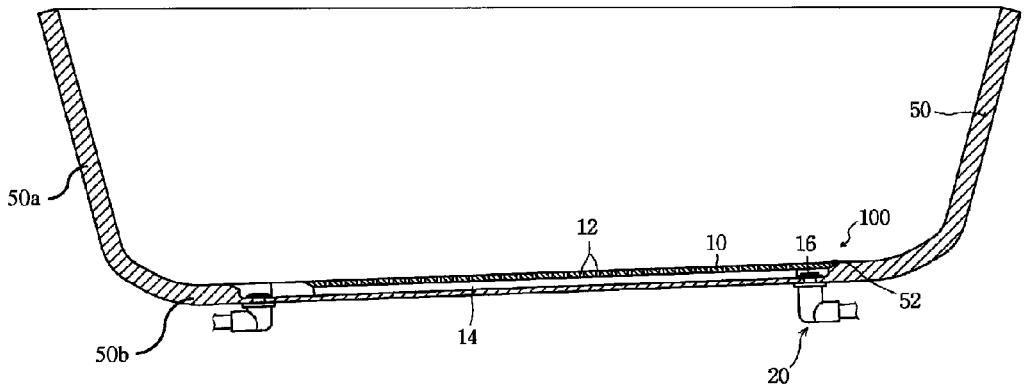
FIG. 1 is a sectional view showing the whole configuration of an air injection bathtub according to a first embodiment of the present invention.
Figure 2:
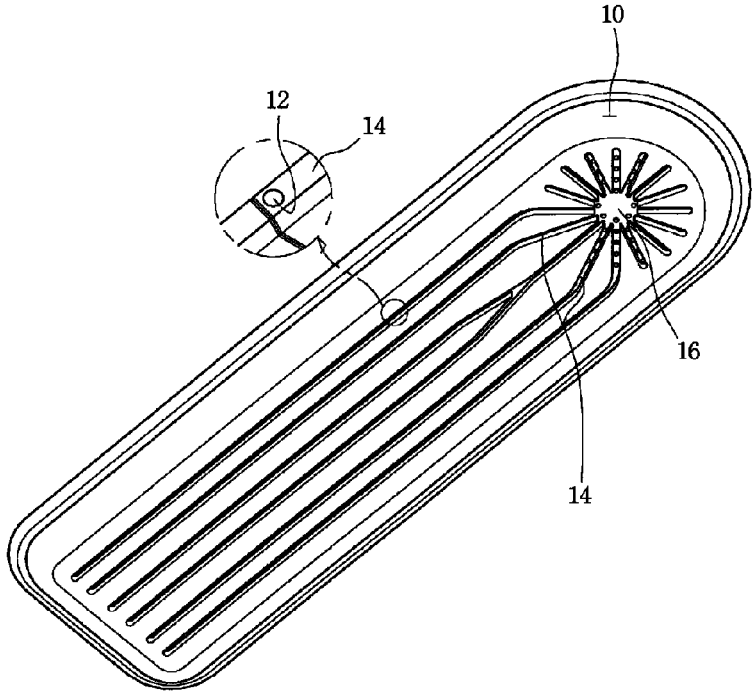
FIG. 2 is a perspective view showing the bottom surface of the air injection bathtub of FIG. 1.
Figure 3:
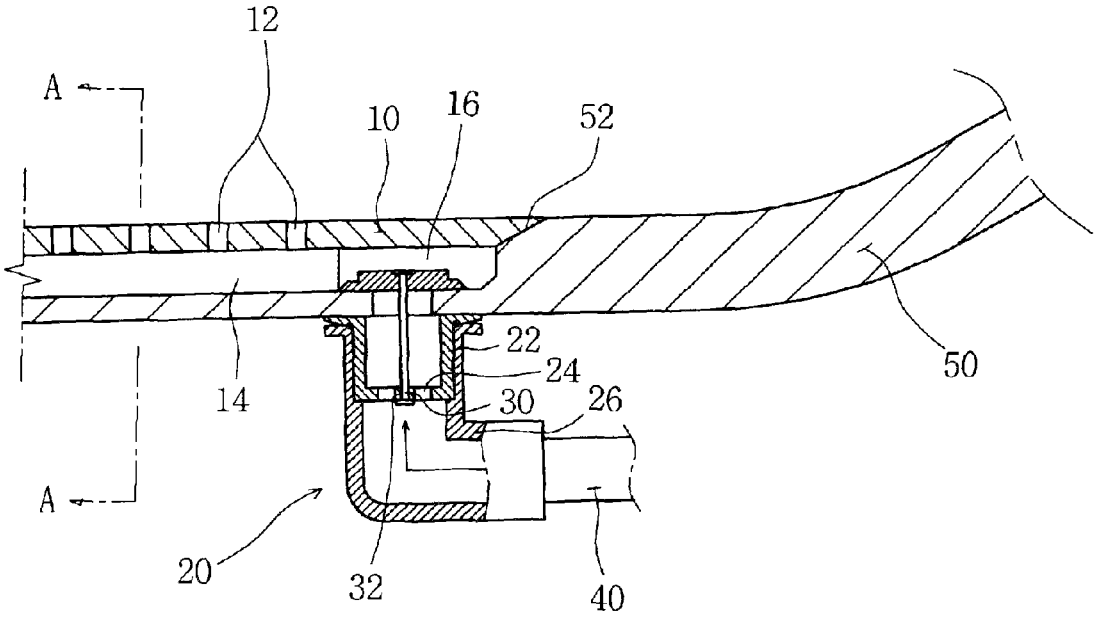
FIG. 3 is a sectional view showing the main parts of FIG. 1.
Figure 4:
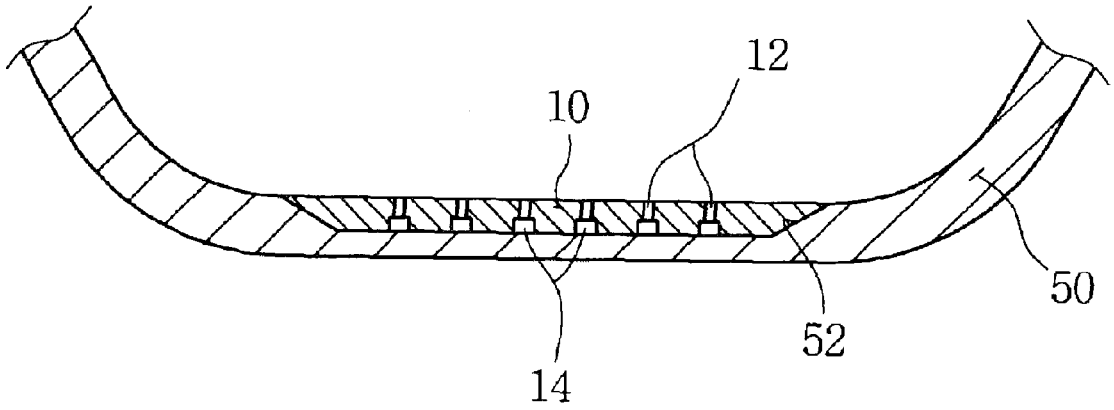
FIG. 4 is a sectional view taken along the line A-A of FIG. 2.

FIG. 1 is a sectional view showing the whole configuration of an air injection bathtub according to a first embodiment of the present invention, FIG. 2 is a perspective view showing the bottom surface of the air injection bathtub of FIG. 1, FIG. 3 is a sectional view showing the main parts of FIG. 1, and FIG. 4 is a sectional view taken along the line A-A of FIG. 3.

As shown in FIGS. 1 to 4, an air injection bathtub 100 according to a first embodiment of the present invention largely includes a body part 50 formed with a side wall portion 50*a* and a lower or bottom portion 50*b*, and a plate part 10 and a valve part 20, the combination of which constitutes an air injection device 100.

The plate part 10 forms the outer shape of the air injection device 100 and has a given length in such a manner as to be fitted to a coupling recess 52 formed on the bottom surface of the body part 50 of the bathtub The plate part 10 has a plurality of air injection through-holes 12 formed on the top surface thereof, through which the air supplied from the valve part 20 through the activation of an air blower (not shown) disposed outside of the bathtub is injected into an internal space 54 of the body part 50 of the bathtub, thereby generating air bubbles from the water stored in the bathtub.

The plate part 10 further has a plurality of elongated air passing grooves 14 equally spaced apart from one another on the underside surface thereof. The air passing grooves 14 communicate with the air injection through-holes 12 formed on the top surface of the plate part 10, thereby serving as the passages for allowing the air supplied from the outside to be passed through the air injection through-holes 12.

The plate part 10 further has a circular connection groove 16 formed depressedly on one side of the underside surface thereof. The connection groove 16 communicates with the air passing grooves 14, thereby serving to allow the air supplied by the opening operation of the valve part 20 to be passed through the air passing grooves 14.

Figure 5:
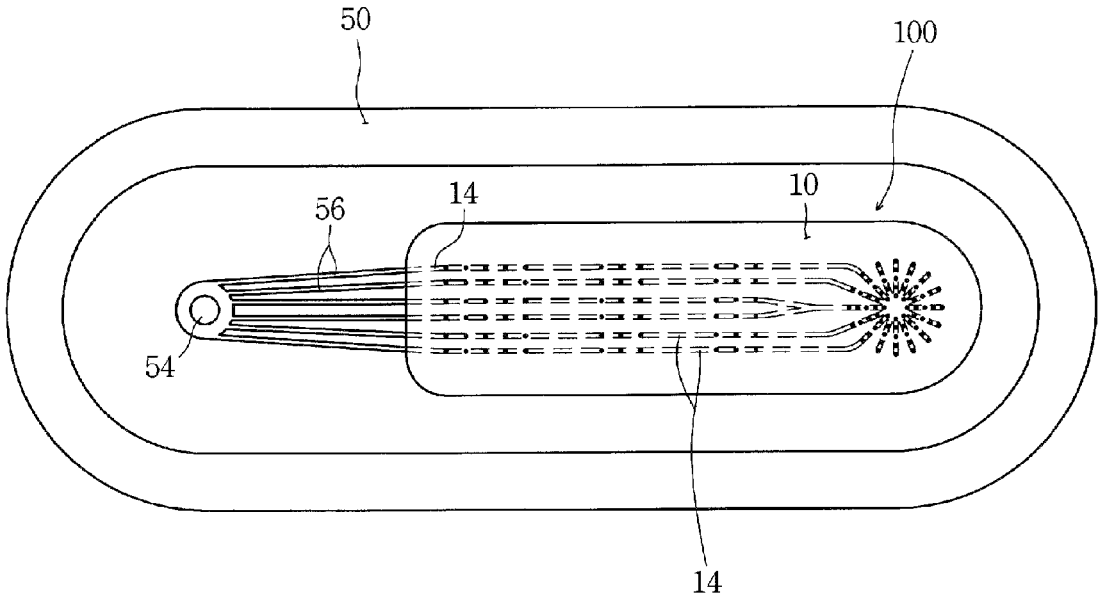
FIG. 5 is a plan view showing the bathtub of FIG. 1.
Figure 6:
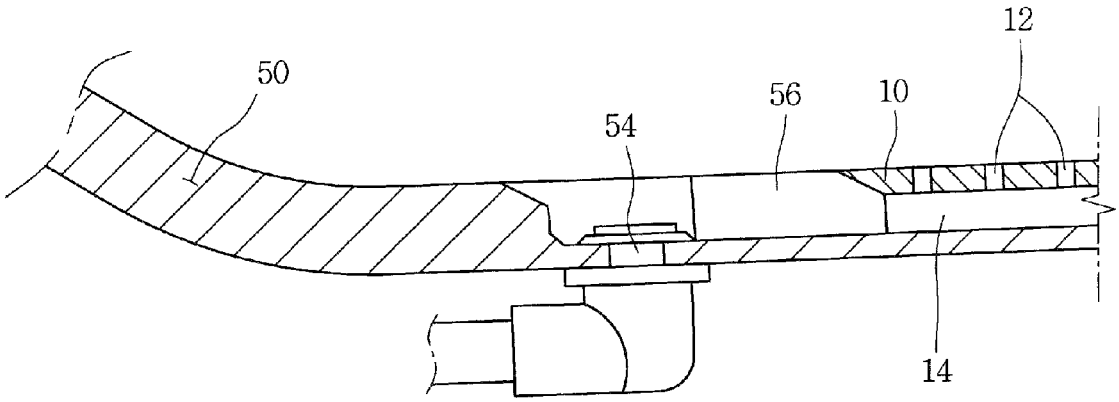
FIG. 6 is a sectional view showing a drain of the bathtub FIG. 5.

On the other hand, as shown in FIGS. 5 and 6, the body part 50 has a drain 54 formed on underside surface thereof and at least one or more drain induction grooves 56 formed depressedly along one side outer periphery of the drain 54. The drain induction grooves 56 are connected at one ends thereof to the air passing grooves 14 of the plate part 10 and connected at the other ends thereof to the drain 54 of the body part 50 of the bathtub, thereby gently inducing and draining the water existing in the air passing grooves 14 to the drain 54 and preventing the water from remaining in the air passing grooves 14, so that foreign matters like water scale are not generated in the air passing grooves 14 while the bathtub is being in use, thereby keeping the bathtub in a clean state.

The valve part 20 is coupled to the connection groove 16 of the plate part 10. The valve part 20 is connected to the air blower disposed outside of the bathtub by means of a connection pipe 40 and is open and closed through the air pressure supplied from the connection pipe 40 in accordance with the activation of the air blower, thereby discharging the air to the air passing grooves 14.

Figure 7:
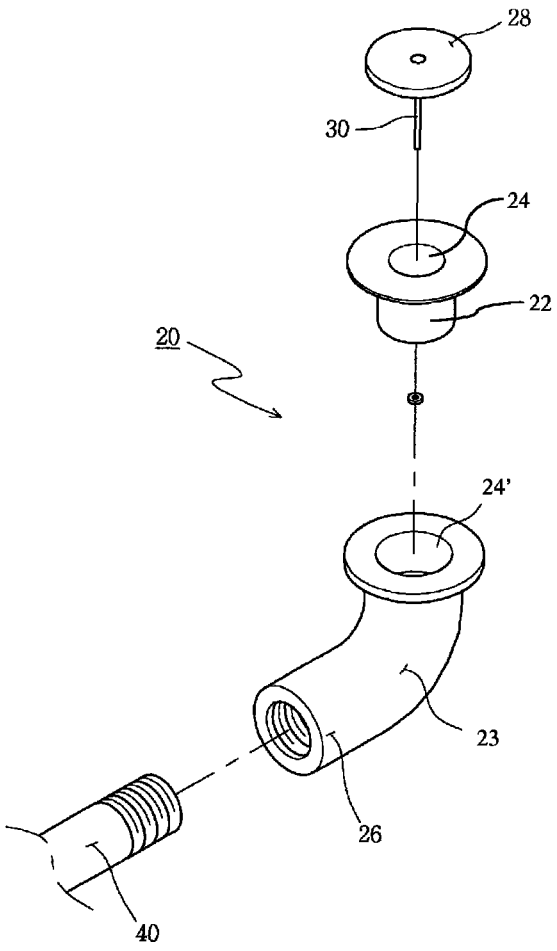
FIG. 7 is an exploded perspective view showing a valve part of FIG. 1.

FIG. 7 is an exploded perspective view showing a valve part of FIG. 1.

As shown in FIG. 7, the valve part 20 includes: a body 22 having a shape of a hollow cylinder open on the upper portion thereof in such a manner as to be disposed below the connection groove 16 of the plate part 10, an elbow 23 having a fastening portion 26 formed unitarily to one side thereof, into which the connection pipe 40 is fittedly inserted, and an air passing through-holes 24 and 24' formed through the body 22 and the elbow 23, through which the air supplied through the connection pipe 40 is passed; a cover plate 28 adapted to be covered on the open top surface of the body 22 in such a manner as to be moved upwardly by the air pressure introduced into the body 22 through the air passing through-holes 24 and 24' and thus to open the through passage of the body 22; and a guide shaft 30 coupled at one end thereof to the center of the underside surface of the cover plate 28 and coupled fittedly at the other end thereof to a through-hole 32 formed at the center of the bottom surface of the body 22, the guide shaft 30 serving to guide the upward and downward operations of the cover plate 28 through the air pressure.

Next, an explanation on the operation of the air injection bathtub according to the first embodiment of the present invention will be given with reference to FIGS. 1 to 7.

First, if air is supplied to the body 22 of the valve part 20 through the connection pipe 40 by the activation of the air blower, the supplied air is introduced into the body 22 of the valve part 20 through the air passing through-hole 24 formed through the body 22, and thus, the cover plate 28 placed on the top surface of the body 22 is moved upwardly by the air pressure introduced into the body 22 to open the air passage of the body 22. As a result, the air is introduced into the connection groove 16 formed at one side of the underside surface of the plate part 10.

Next, the air introduced into the connection groove 16 is passed through the air passing grooves 14 equally spaced apart from one another on the underside surface of the plate part 10 connected to the connection groove 16, and is then injected into the bathtub through the air injection through-holes 12 communicating with the air passing grooves 14 and formed on the top surface of the plate part 10. As a result, air bubbles are generated from the water stored into the body part 50 of the bathtub.

On the other hand, if the air pressure is not supplied anymore to the cover plate 28 of the valve part 20 by the stop of the activation of the air blower, the cover plate 28 is moved downwardly by its own weight to close the top surface of the body 22. After the closing of the cover plate 28, the water stored into the bathtub is passed through the air injection through-holes 12 of the plate part 10 and is then introduced into the air passing grooves 14 formed on the underside surface of the plate part 10. At this time, if the air blower is restarted to supply air to the air passing grooves 14, the water introduced into the air passing grooves 14 is injected into the body part 50 of the bathtub through the air injection through-holes 12, thereby basically preventing the water from remaining in the air injection device 100. As a result, the generation of foreign matters like water scale caused by the water remaining in the air passing grooves 14 can be previously prevented to keep the bathtub in a clean state.

Second Embodiment

Figure 8:
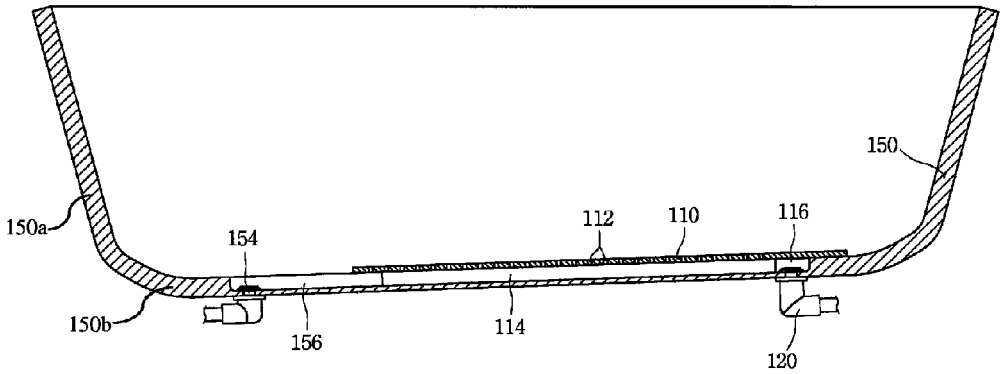
FIG. 8 is a sectional view showing the whole configuration of an air injection bathtub according to a second embodiment of the present invention.
Figure 9:
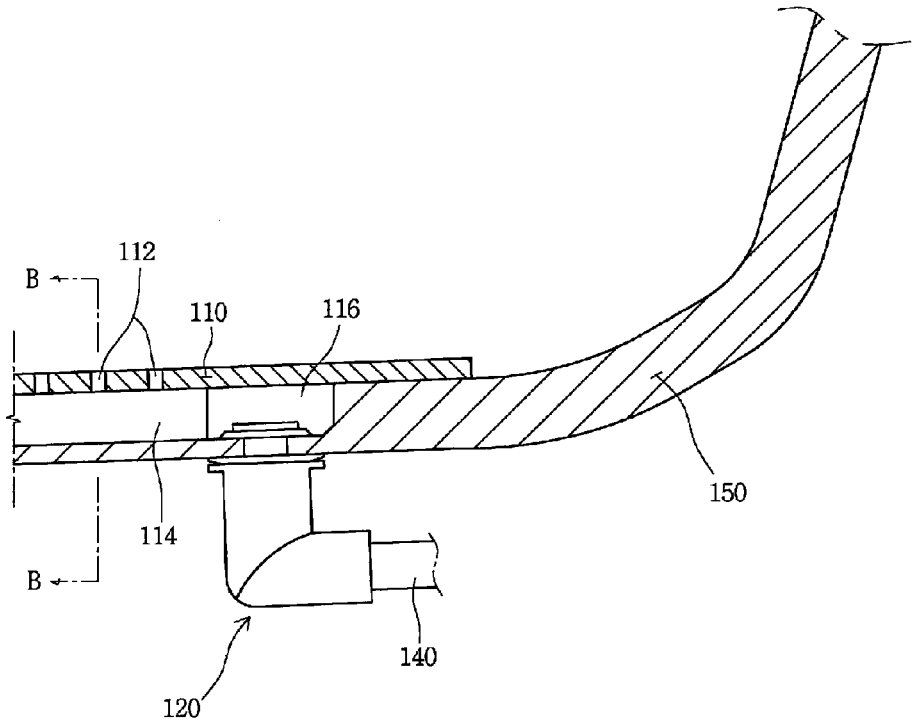
FIG. 9 is a sectional view showing a portion of the main parts of FIG. 8.
Figure 10:
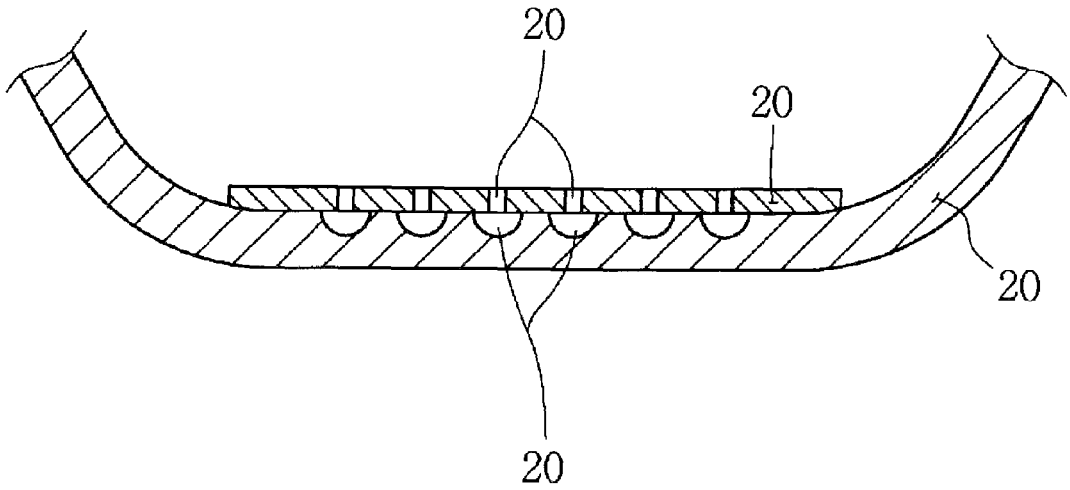
FIG. 10 is a sectional view taken along the line B-B of FIG. 9.
Figure 11:
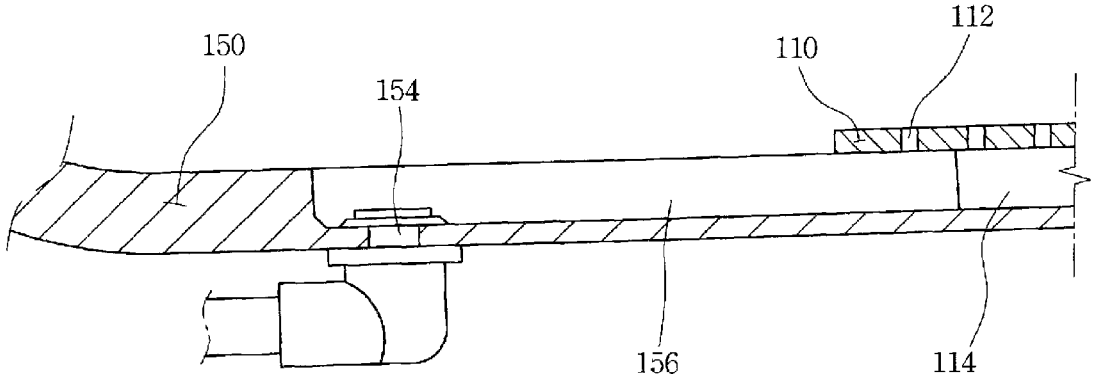
FIG. 11 is a sectional view showing a drain of the bathtub FIG. 8.

FIG. 8 is a sectional view showing the whole configuration of an air injection bathtub according to a second embodiment of the present invention, FIG. 9 is a sectional view showing a portion of the main parts of FIG. 8, FIG. 10 is a sectional view taken along the line B-B of FIG. 9, and FIG. 11 is a sectional view showing a drain of the bathtub FIG. 8.

As shown in FIGS. 8 to 11, an air injection bathtub according to a second embodiment of the present invention largely includes a body part 150 formed with a side wall portion **150*a* and a bottom portion 150*b*, and a plate part 110 and a valve part 120**, the combination of which constitutes the air injection device.

The plate part 110 forms the outer shape of the air injection device and has a given length in such a manner as to be disposed on the bottom surface of the body part 150 of the bathtub.

The plate part 110 has a plurality of air injection through-holes 112 formed on the top surface thereof, through which the air supplied from the valve part 120 through the activation of an air blower (not shown) disposed outside of the bathtub is injected into the internal space of the body part 150 of the bathtub, thereby generating air bubbles from the water stored into the bathtub.

On the other hand, the body part 150 has a plurality of elongated air passing grooves 114 equally spaced apart from one another on the bottom surface on which the plate body 110 is disposed. The air passing grooves 114 communicate with the air injection through-holes 112 formed on the top surface of the plate part 110, thereby serving as the passages for allowing the air supplied from the outside to be passed through the air injection through-holes 12.

The body part 150 of the bathtub has a circular connection groove 116 formed depressedly on one side of the bottom surface thereof. The connection groove 116 communicates with the air passing grooves 114, thereby serving to allow the air supplied by the opening operation of the valve part 20 to be passed through the air passing grooves 114.

On the other hand, as shown in FIG. 8, the body part 150 has a drain 154 formed on underside surface thereof and at least one or more drain induction grooves 156 formed depressedly along one side outer periphery of the drain 154. The drain induction grooves 156 are connected at one ends thereof to the air passing grooves 114 of the body part 150 and connected at the other ends thereof to the drain 154 of the body part 150 of the bathtub, thereby gently inducing and draining the water existing in the air passing grooves 114 to the drain 154 and preventing the water from remaining in the air passing grooves 114, so that foreign matters like water scale are not generated in the air passing grooves 114 while the bathtub is being in use.

The valve part 120 is coupled to the connection groove 116 of the body part 150 of the bathtub. The valve part 120 is connected to the air blower disposed outside of the bathtub by means of a connection pipe 140 and is open and closed through the air pressure supplied from the connection pipe 140 in accordance with the activation of the air blower, thereby discharging the air to the air passing grooves 114 of the body part 150 of the bathtub. The valve part 120 is configured in the same manner as the valve part 20 of the first embodiment of the present invention, and therefore, a detailed description thereon is avoided.

According to the air injection bathtub according to the second embodiment of the present invention, if air is introduced into the connection groove 116 formed at one side of the bottom surface of the body part 150 of the bathtub in accordance with the operation of the valve part 120, the air introduced into the connection groove 116 is passed through the air passing grooves 114 formed on the body part 150 connected to the connection groove 116, and is then injected into the interior of the body part 150 of the bathtub through the air injection through-holes 112 communicating with the air passing grooves 114 and formed on the top surface of the plate part 110. As a result, air bubbles are generated from the water stored into the body part 150 of the bathtub.

On the other hand, a portion of water stored in the bathtub is passed through the air injection through-holes 112 of the plate part 110 and is then introduced into the air passing grooves 114. At this time, the water introduced into the air passing grooves 114 is injected again into the body part 150 of the bathtub through the air injection through-holes 112 by the air pressure supplied from the air passing grooves 114. As a result, the water does not remain in the air passing grooves 114, thereby preventing foreign matters like water scale from being generated therein.

Even though the water is not injected by the air pressure, further, the water remaining in the air passing grooves 114 is passed through the drain induction grooves 156 and is naturally drained through the drain 154 of the body part 150 of the bathtub, thereby keeping the bathtub in a more clean state.

Third Embodiment

Figure 12:
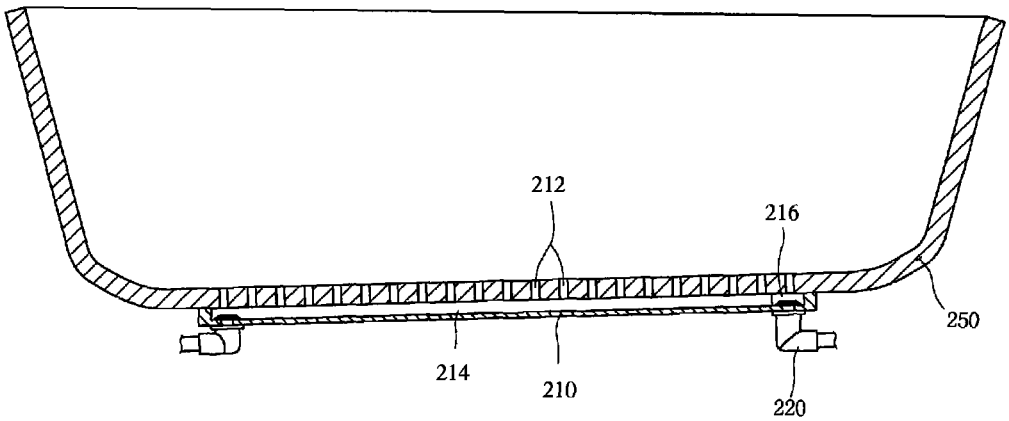
FIG. 12 is a sectional view showing the whole configuration of an air injection bathtub according to a third embodiment of the present invention.
Figure 13:
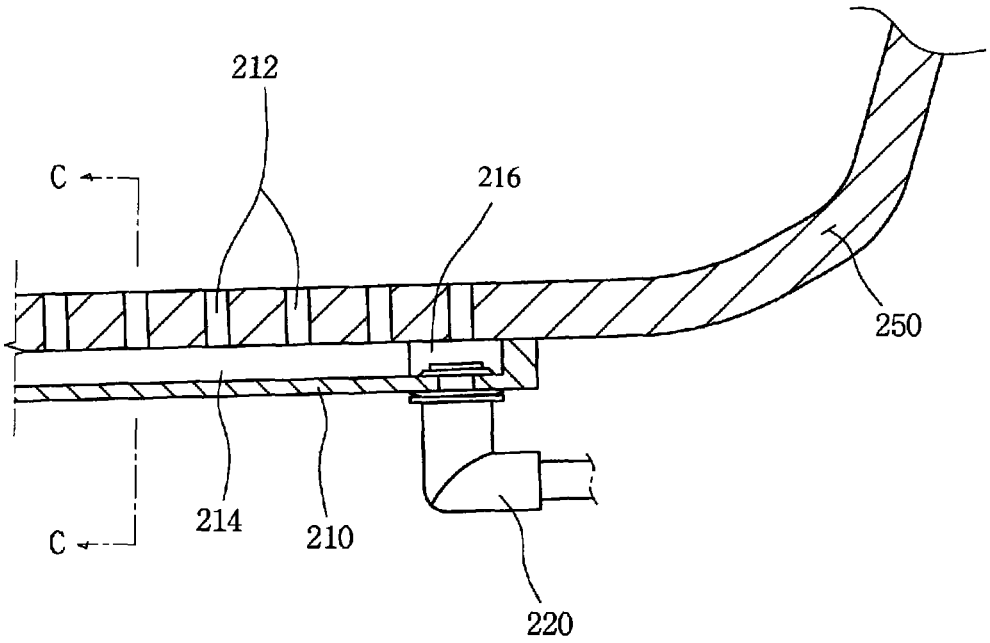
FIG. 13 is a sectional view showing a portion of the main parts of FIG. 12.
Figure 14:
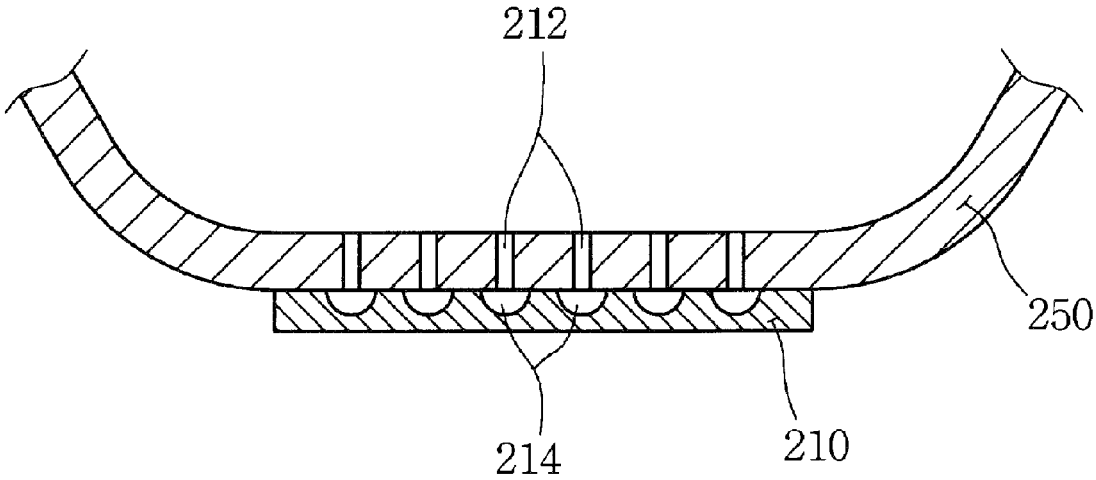
FIG. 14 is a sectional view taken along the line C-C of FIG. 13.

FIG. 12 is a sectional view showing the whole configuration of an air injection bathtub according to a third embodiment of the present invention, FIG. 13 is a sectional view showing a portion of the main parts of FIG. 12, and FIG. 14 is a sectional view taken along the line C-C of FIG. 13.

As shown in FIGS. 12 to 14, an air injection bathtub according to a third embodiment of the present invention largely includes a body part 250 having a plurality of air injection through-holes 212 formed on the bottom surface thereof and a plate part 210 attached on the underside surface of the body part 250.

The plurality of air injection through-holes 212 formed on the bottom surface of the body part 250 of the bathtub is adapted to inject the air supplied from a valve part 220 through the activation of an air blower (not shown) disposed outside into the internal space of the body part 250 of the bathtub, thereby generating air bubbles from the water stored into the bathtub.

The plate part 210 has a plurality of elongated air passing grooves 214 equally spaced apart from one another on the underside surface thereof. The air passing grooves 214 communicate with the air injection through-holes 212 formed on the top surface of the body part 250 of the bathtub, thereby serving as the passages for allowing the air supplied from the outside to be passed through the air injection through-holes 212.

The plate part 210 has a circular connection groove 216 formed depressedly on one side of the top surface thereof. The connection groove 216 communicates with the air passing grooves 214, thereby serving to allow the air supplied by the opening operation of the valve part 220 to be passed through the air passing grooves 214.

The valve part 220 is coupled to the connection groove 216 of the plate part 210. The valve part 220 is connected to the air blower disposed outside of the bathtub by means of a connection pipe 240 and is open and closed through the air pressure supplied from the connection pipe 240 in accordance with the activation of the air blower, thereby discharging the air to the air passing grooves 214 of the plate part 210. The valve part 220 is configured in the same manner as the valve part 20 of the first embodiment of the present invention, and therefore, a detailed description thereon is avoided.

According to the air injection bathtub according to the third embodiment of the present invention, if air is introduced into the connection groove 216 formed at one side of the top surface of the plate part 210 in accordance with the operation of the valve part 220, the air introduced into the connection groove 216 is passed through the air passing grooves 214 of the plate part 210 connected to the connection groove 216, and is then injected into the interior of the body part 250 of the bathtub through the air injection through-holes 212 communicating with the air passing grooves 214 and formed on the bottom surface of the body part 250 of the bathtub. As a result, air bubbles are generated from the water stored in the body part 250 of the bathtub.

On the other hand, a portion of water stored into the body part 250 of the bathtub is passed through the air injection through-holes 212 and is then introduced into the air passing grooves 214. At this time, the water introduced into the air passing grooves 214 is injected again into the body part 250 of the bathtub through the air injection through-holes 212 by the air pressure supplied from the air passing grooves 214. As a result, the water does not remain in the air passing grooves 214, thereby preventing foreign matters like water scale from being generated therein.

Fourth Embodiment

Figure 15:
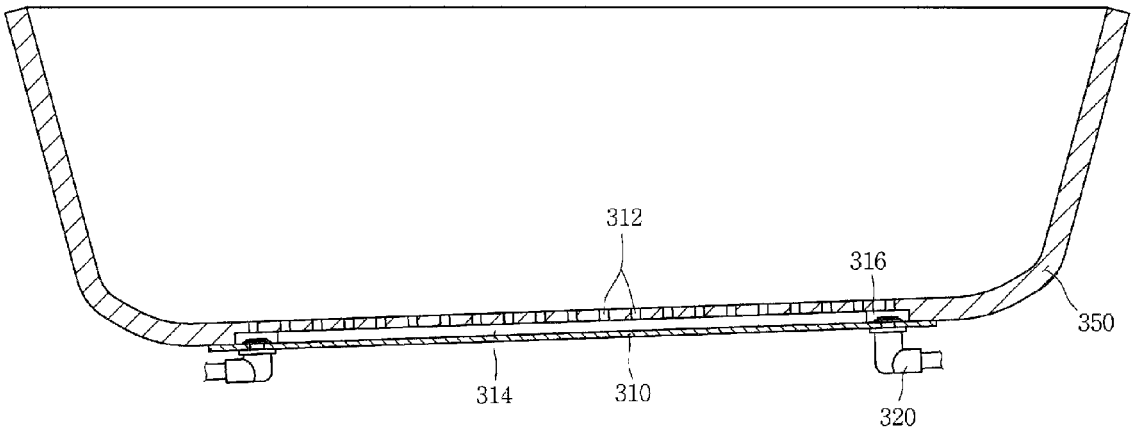
FIG. 15 is a sectional view showing the whole configuration of an air injection bathtub according to a fourth embodiment of the present invention.
Figure 16:
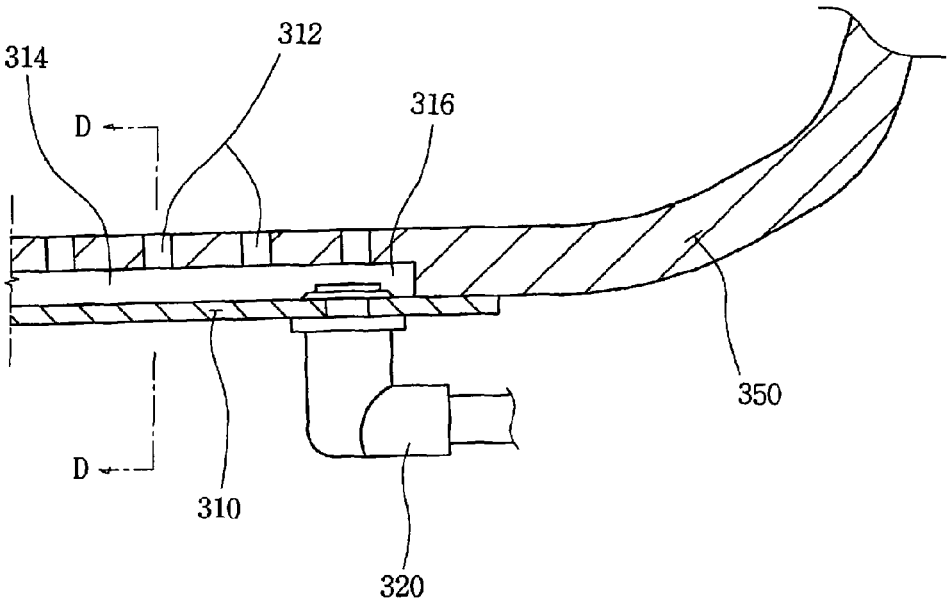
FIG. 16 is a sectional view showing a portion of the main parts of FIG. 15.
Figure 17:
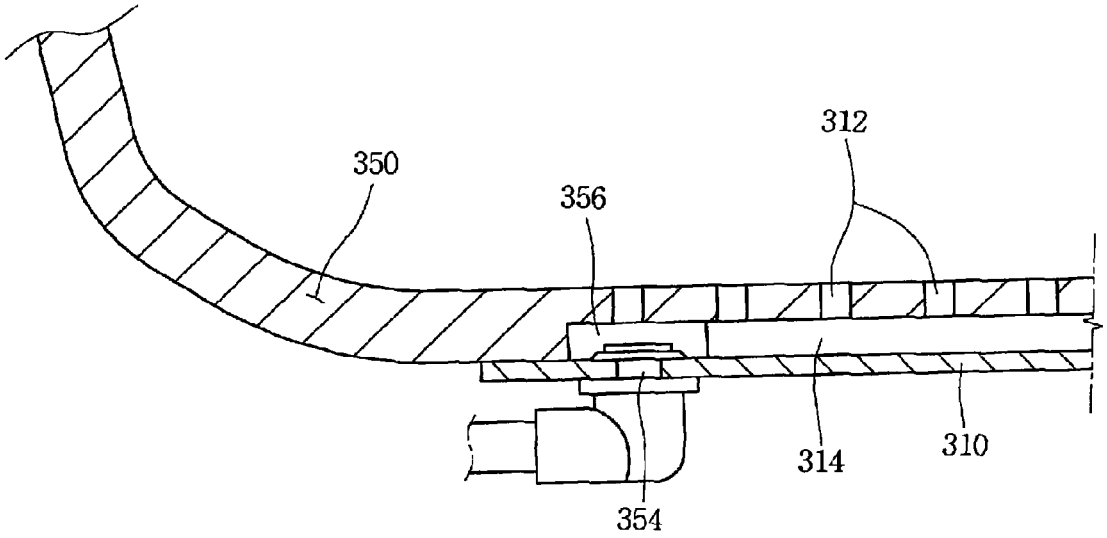
FIG. 17 is a sectional view showing a drain of the bathtub FIG. 15.
Figure 18:
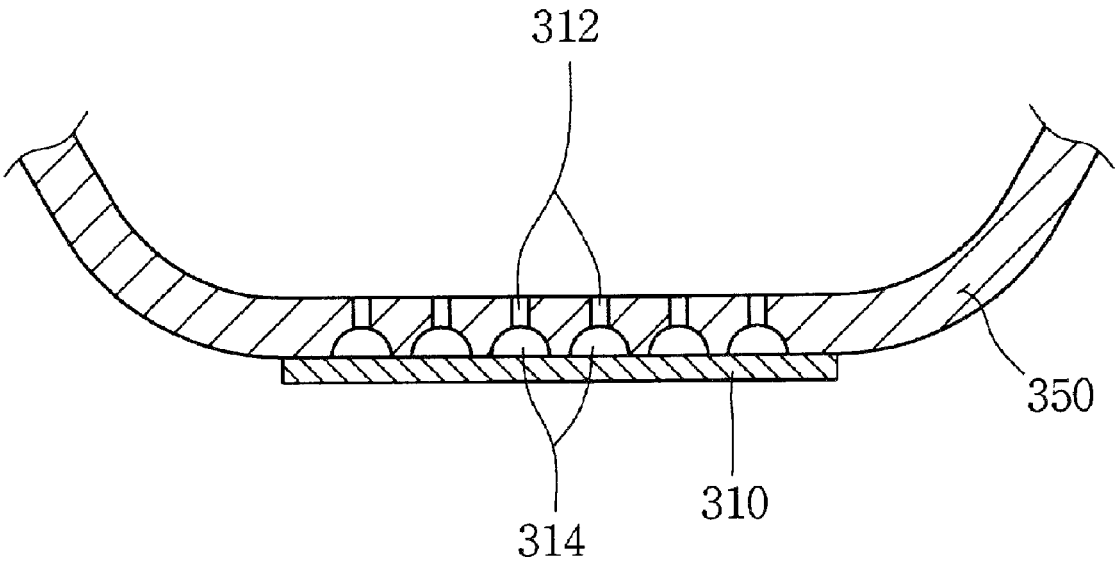
FIG. 18 is a sectional view taken along the line D-D of FIG. 16.

FIG. 15 is a sectional view showing the whole configuration of an air injection bathtub according to a fourth embodiment of the present invention, FIG. 16 is a sectional view showing a portion of the main parts of FIG. 15, FIG. 17 is a sectional view showing a drain of the bathtub FIG. 15, and FIG. 18 is a sectional view taken along the line D-D of FIG. 16.

As shown in FIGS. 15 to 18, an air injection bathtub according to a fourth embodiment of the present invention largely includes a body part 350 having a plurality of air injection through-holes 312 formed on the bottom surface thereof and a plurality of air passing grooves 314 formed on the underside surface thereof, and a plate part 310 attached sealingly on the underside surface of the body part 250.

The body part 350 of the bathtub has a circular connection groove 316 formed depressedly on one side of the bottom surface thereof. The connection groove 316 communicates with the air passing grooves 314 of the body part 350 of the bathtub, thereby serving to allow the air supplied by the opening operation of a valve part 320 to be passed through the air passing grooves 314.

The valve part 320 is coupled to the connection groove 316 of the body part 350. The valve part 320 is connected to the air blower disposed outside of the bathtub by means of a connection pipe 340 and is open and closed through the air pressure supplied from the connection pipe 340 in accordance with the activation of the air blower, thereby discharging the air to the air passing grooves 314 of the body part 350. The valve part 320 is configured in the same manner as the valve part 20 of the first embodiment of the present invention, and therefore, a detailed description thereon is avoided.

On the other hand, the body part 350 has a drain 354 formed on underside surface thereof and at least one or more drain induction grooves 356 formed depressedly along one side outer periphery of the drain 354. The drain induction grooves 356 are connected at one ends thereof to the air passing grooves 314 of the body part 350 and connected at the other ends thereof to the drain 354 of the body part 350 of the bathtub, thereby gently inducing and draining the water existing in the air passing grooves 314 to the drain 354 and preventing the water from remaining in the air passing grooves 314, so that foreign matters like water scale are not generated in the air passing grooves 314 while the bathtub is being in use.

According to the air injection bathtub according to the fourth embodiment of the present invention, if air is introduced into the connection groove 316 formed at one side of the underside surface of the body part 350 in accordance with the operation of the valve part 320, the air introduced into the connection groove 316 is passed through the air passing grooves 314 of the body part 350 connected to the connection groove 316, and is then injected into the interior of the body part 350 of the bathtub through the air injection through-holes 312 communicating with the air passing grooves 314 and formed on the bottom surface of the body part 350 of the bathtub. As a result, air bubbles are generated from the water stored into the body part 350 of the bathtub, and the water does not remain in the air passing grooves 314, thereby preventing foreign matters like water scale from being generated therein.

Even though the water is not injected by the air pressure, further, the water remaining in the air passing grooves 314 is passed through the drain induction grooves 356 of the body part 350 and is naturally drained through the drain 354 of the body part 350 of the bathtub, thereby keeping the bathtub in a more clean state.

What is claimed is:

1. An air injection bathtub comprising:

a body part having a side wall portion and a bottom portion for retaining water in the body part;

a plate part having a plate shape extending generally horizontally to cover a substantial surface area of the bottom portion of the body part and in parallel relation to an upper surface of the bottom portion of the body part, the plate part attached at an upper side of the bottom portion of the body part;

a valve disposed below the bottom portion of the body part and having an air conduit coupled thereto to supply air into the water retained in the body part; and a plurality of air injection through-holes formed in the plate part, wherein the body part and the plate part have a connection groove and a plurality of elongated air passing grooves disposed between the body part and the plate part, the connection groove disposed at a corresponding location to the valve, wherein said plurality of elongated air passing grooves communicate with the connection groove, and wherein said plurality of air injection through-holes are distributed in the plate part at locations corresponding to the elongated air passing grooves to deliver air to the air injection through-holes through the elongated air passing grooves and via the air conduit and the valve to generate air bubbles in the water.

2. The air injection bathtub according to claim 1, wherein the valve comprises:

a valve body coupled to the air conduit, the valve body having an air passing through-hole formed therethrough, through which the air is supplied from outside; and a cover plate coupled to the valve body and moveable between a closed position to close the air passing through-hole of the valve body and an open position to open the air passing through-hole of the valve body to supply air into the water through the valve.

3. The air injection bathtub according to claim 1, wherein the valve further comprises:

a guide shaft extending downward from a central area of the over plate and coupled to a through-hole formed at a lower portion of the valve body in such a manner as to guide upward and downward movements of the cover plate by external air pressure to operate the valve between the open and closed positions.

4. The air injection bathtub according to claim 1, further comprising a drain coupled to the bottom portion of the body part, and one or more drain induction grooves disposed in fluid communication with the drain and with said elongated air passing grooves to facilitate the water remaining in the elongated air passing grooves to drain.

5. The air injection bathtub according to claim 1, wherein the body part has a coupling recess formed at an upper surface of the bottom portion of the body part, wherein the plate part is coupled to the coupling recess of the body part, wherein said plurality of air injection through-holes are formed in the plate part, wherein said connection groove and said elongated air passing grooves are formed at a lower surface of the plate part.

6. The air injection bathtub according to claim 5, wherein the body part has a drain coupled to the bottom portion of the body part, and one or more drain induction grooves formed at the upper surface of the bottom portion of the body part in fluid communication with the drain and with said elongated air passing grooves to facilitate the water remaining in the elongated air passing grooves to drain.

7. The air injection bathtub according to claim 1, wherein the plate part is coupled to the upper side of the bottom portion of the body part, wherein said plurality of air injection through-holes are formed in the plate part, wherein said connection groove and said elongated air passing grooves are formed at an upper surface of the bottom portion of the body part.

8. The air injection bathtub according to claim 7, wherein the body part has a drain coupled to the bottom portion of the body part, and one or more drain induction grooves formed at the upper surface of the bottom portion of the body part in fluid communication with the drain and with said elongated air passing grooves to facilitate the water remaining in the elongated air passing grooves to drain.

* * * * *